US010100384B2

(12) United States Patent
Delhaes et al.

(10) Patent No.: US 10,100,384 B2
(45) Date of Patent: Oct. 16, 2018

(54) METHOD FOR PRODUCING A TEMPERED SEAMLESSLY HOT-FABRICATED STEEL PIPE

(71) Applicant: Vallourec Deutschland GmbH, Duesseldof (DE)

(72) Inventors: Christof Delhaes, Mettmann (DE); Heiko Hansen, Schwalmtal (DE); Rolf Kuemmerling, Duisburg (DE)

(73) Assignee: Vallourec Deutschland GmbH, Düsseldorf (DE)

( * ) Notice: Subject to any disclaimer, the term of this patent is extended or adjusted under 35 U.S.C. 154(b) by 274 days.

(21) Appl. No.: 14/911,042

(22) PCT Filed: Aug. 11, 2014

(86) PCT No.: PCT/EP2014/067170

§ 371 (c)(1),
(2) Date: Feb. 9, 2016

(87) PCT Pub. No.: WO2015/022294

PCT Pub. Date: Feb. 19, 2015

(65) Prior Publication Data

US 2016/0376677 A1 Dec. 29, 2016

(51) Int. Cl.
*C21D 8/10* (2006.01)
*C21D 9/08* (2006.01)
(Continued)

(52) U.S. Cl.
CPC ..... *C21D 9/085* (2013.01); *C21D 1/18* (2013.01); *C21D 1/60* (2013.01); *C21D 8/105* (2013.01);
(Continued)

(58) Field of Classification Search
None
See application file for complete search history.

(56) References Cited

U.S. PATENT DOCUMENTS 4,075,041 A 2/1978 Ueno et al.
2009/0038358 A1 2/2009 Osaka

FOREIGN PATENT DOCUMENTS

CN 101993991 A 3/2011
DE 2601625 A1 7/1976
(Continued)

OTHER PUBLICATIONS

Machine English translation of CN 101993991 A, Yong Zhou et al., Mar. 30, 2011.*
(Continued)

*Primary Examiner* — Deborah Yee
(74) *Attorney, Agent, or Firm* — Gardner, Linn, Burkhart & Ondersma, LLP

(57) ABSTRACT

A method for producing a tempered, seamlessly hot-rolled steel pipe includes heating a hollow block to forming temperature and rolling the heated block in a rolling mill to form a pipe with a finished diameter after rolling. Subsequently, the pipe is tempered with appropriate tempering parameters after rolling whereby the diameter of the pipe increases during tempering. The finished diameter of the pipe to be tempered after rolling in the rolling mill is adjusted as a function of a value of the growth in diameter of the pipe during tempering.

19 Claims, 5 Drawing Sheets

(51) Int. Cl.

| | |
|---|---|
| ***C21D 9/14*** | (2006.01) |
| ***C21D 1/18*** | (2006.01) |
| ***C21D 1/60*** | (2006.01) |
| *B21B 23/00* | (2006.01) |

(52) U.S. Cl.
CPC ..... *C21D 9/08* (2013.01); *C21D 9/14* (2013.01); *B21B 23/00* (2013.01); *B21B 2261/08* (2013.01)

(56) References Cited

FOREIGN PATENT DOCUMENTS

| | | | |
|---|---|---|---|
| DE | 2649019 | A1 | 12/1977 |
| DE | 3127373 | A1 | 1/1983 |
| JP | 2006307245 | A | 11/2006 |

OTHER PUBLICATIONS

Preliminary Report on Patentability of the International Searching Authority in English from corresponding Patent Cooperation Treaty (PCT) Application No. PCT/EP2014/067170, dated Feb. 16, 2016.
International Search Report and Written Opinion of the International Searching Authority from corresponding Patent Cooperation Treaty (PCT) Application No. PCT/EP2014/067170, Nov. 17, 2014.

* cited by examiner

Legend:

W = Wall thickness
G = Material quality
S = Specification
X = Target diameter after tempering
= Minimum growth of the pipe diameter during tempering
= Region of influence of the diameter growth
= permitted region for the diameter prior to tempering

| Dimensions (mm) | Nominal diameter (mm) | Wall (mm) | Flow rate | Average ∅ growth [mm] | Average ∅ growth [%] |
|---|---|---|---|---|---|
| 355 x 14 | 355 | 14 | 35% | 0.81 | 0.23 |
| 406 x 14 | 406 | 14 | 35% | 1.40 | 0.34 |

| Dimensions (mm) | Nominal diameter (mm) | Wall (mm) | Flow rate | Average ∅ growth [mm] | Average ∅ growth [%] |
|---|---|---|---|---|---|
| 244 x 12 | 244 | 12 | 22% | 0.10 | 0.04 |
| 339 x 12 | 339 | 12 | 22% | 0.62 | 0.18 |
| 406 x 12 | 406 | 12 | 22% | 1.11 | 0.27 |

| Quality | Nominal diameter (mm) | Wall (mm) | Flow rate | Average ∅ growth [mm] | Average ∅ growth [%] |
|---|---|---|---|---|---|
| P110EC | 406.4 | 14.6 | 16% | 1.04 | 0.26 |
| P110EC | 406.4 | 14.6 | 20% | 1.26 | 0.31 |
| P110EC | 406.4 | 14.6 | 24% | 1.46 | 0.36 |

| Quality | Nominal diameter (mm) | Wall (mm) | Flow rate | Average ∅ growth [mm] | Average ∅ growth [%] |
|---|---|---|---|---|---|
| P110EC | 406.4 | 14.6 | 21% | 1.35 | 0.33 |
| P110EC | 406.4 | 14.6 | 35% | 1.11 | 0.27 |
| P110EC | 406.4 | 14.6 | 40% | 0.90 | 0.22 |

METHOD FOR PRODUCING A TEMPERED SEAMLESSLY HOT-FABRICATED STEEL PIPE

CROSS REFERENCE TO RELATED APPLICATION

The present application claims the priority benefits of International Patent Application No. PCT/EP2014/067170, filed on Aug. 11, 2014, which is hereby incorporated herein by reference in its entirety.

BACKGROUND OF THE INVENTION

The invention relates to a method for producing a tempered, seamlessly hot-rolled steel pipe, in which a hollow block heated to forming temperature is rolled in a rolling mill to form a pipe with a finished diameter after rolling and is subsequently tempered with appropriate tempering parameters.

Since the Mannesmann brothers' invention for producing a thick-walled hollow block pipe from a heated block, various proposals have been made for stretching this hollow block pipe in the same heat in a further hot working stage, upon which the outer diameter is reduced to the finished diameter of the rolling mill.

Key words in relation to this are the continuous pipe rolling method, the push bench method, the Stiefel process and the Pilger process (Stahlrohr-Handbuch, $10^{th}$ edition, published by Vulkan-Verlag Essen 1986, III. Herstellverfahren).

All of the named methods are preferred for different dimensional ranges and materials, wherein there is also some overlapping. For the middle dimensional range of 5" to 18" the continuous pipe rolling method and Stiefel process are used, for the dimensional range of up to 26" the Pilger process is used. In the case of a thicker wall in the range of >30 mm the continuous pipe rolling method and Stiefel process are less suitable, while the Pilger process does not have any problems with the wall thickness but is slower in terms of production cycle.

In particular for the use of pipes for the petroleum oil or gas industry, DE 3127373 A1 discloses subjecting the pipes to a tempering treatment after reduction rolling to the finished diameter in order to achieve the required mechanical properties such as strength, durability and expansion. The tempering treatment itself consists, as is known, of heating to austenitization temperature, quenching and annealing.

It is also known that during this tempering treatment, grain growth takes place in the structure of the steel, which leads to an increase in the diameter of the pipe and must be taken into account with respect to the required finished diameter of the finished pipe after tempering.

Furthermore, the pipe expands during heating, and subsequent restriction of the shrinkage upon structural conversion, amongst other things, during the quenching process can also influence the diameter of the finished pipe.

For oil field and conduit pipes, requirements in terms of diameter tolerances, diameter ovality, wall thickness tolerances, weight per meter, driftability, etc., are imposed by standards, such as by the API (American Petroleum Institute) in dependence upon the intended use and dimensioning for the finished pipe.

These requirements lead to a situation where, for production purposes, the target diameter of the pipe after rolling is not always selected to be the same in the case of the same diameter being preset, e.g., by a standard, since this preset diameter is a compromise between production possibilities and production specifications. In addition, the pipe diameter grows more or less in dependence upon the material used and as a result of the change in grain size and the shrinkage restriction during tempering.

The simplest and most popular method for tackling this problem, in particular for diameters equal to or greater than 5½" is to carry out a slight reduction in the diameter at annealing temperature with the aid of a sizing mill. This procedure is known, e.g., from JP 57155325 A or JP 2006307245 A. A sizing mill of this type usually has at least three stands in which the required finished diameters are produced after the pipes are tempered.

There are numerous disadvantages associated with these methods. In addition to the investment and operational costs for the sizing mill, energy consumption is higher since higher annealing temperatures are required for the sizing rolling so that a plastic deformation can take place in the sizing mill during the desired small reduction in diameter. The higher annealing temperatures also make it additionally necessary for the material to contain proportions of alloys in order to achieve the required mechanical-technological properties.

Alternatively, a pipe diameter adapted to the respective pipe after tempering could also be rolled in the rolling mill. However, this would lead to a considerably increased number of pipe diameters to be rolled and to a correspondingly large array of stands.

SUMMARY OF THE INVENTION

The invention provides a production method for tempered, seamlessly hot-finished steel pipes, which permits more economic production of such pipes while respecting the geometric requirements imposed upon the tempered finished pipe.

A method for producing a tempered, seamlessly hot-rolled steel pipe, according to an aspect of the invention, includes heating a hollow block to forming temperature and rolling the heated block in a rolling mill to form a pipe with a finished diameter after rolling with appropriate tempering parameters. Subsequently, the pipe is tempered after rolling with appropriate tempering parameters whereby the diameter of the pipe increases during tempering. The finished diameter of the pipe to be tempered after rolling in the rolling mill is adjusted as a function of a value of the growth in diameter of the pipe during tempering.

In accordance with the teaching of the invention, a method for producing a tempered, seamlessly hot-rolled steel pipe, in which a hollow block heated to forming temperature is rolled in a rolling mill to form a pipe with a finished diameter after rolling and is subsequently tempered and the diameter of the pipe increases during tempering with appropriate tempering parameters, is improved in that, with knowledge of the growth in diameter of the pipe during tempering, the finished diameter of the pipe to be tempered is adjusted after rolling in the rolling mill. The innovative approach of the invention resides in the fact that the knowledge of the influence of the tempering parameters on the changes in the diameter of the pipe owing to tempering for different material qualities and dimensions (diameter, wall thickness) is used to set the finished diameter for the rolling mill.

Provision may be made that the tempering parameters are adjusted in such a way that a pipe with a target diameter which corresponds to a finished diameter after tempering in a preset tolerance range is produced. Tempering parameters are to be understood in particular to be the parameters which have an influence on the cooling rate of the pipe heated to austenitization temperature. The quenching of the heated pipe is effected in accordance with the invention by means of continuous flow cooling since only with this type of cooling is it possible to have a controlled influence on the cooling rate and therefore on the change in diameter. The measurement and monitoring of the influencing cooling parameters are also important. These growth rates are, on the one hand, dependent upon the specific construction of the quenching unit (e.g., annular spray or annular gap shower), the material and diameter/wall thickness ratio product parameters, and, on the other hand, upon the quenching process parameters (with or without internal cooling), pipe speed, water pressure, volume flow, etc.

The production method may be further simplified in that the finished diameter is achieved after tempering without the assistance of sizing rolling. The proposed method has the advantage that it is thereby possible to dispense with sizing rolling after tempering the pipe, so that, on the one hand, the production costs are considerably reduced and, on the other hand, the investment for the expensive sizing mill and the associated costs for maintenance and power are avoided. Furthermore, for diverse material qualities, it is possible to use more favorable operational materials, and achieve lower annealing furnace temperatures with correspondingly lower power consumption. A higher annealing temperature is required for sizing rolling because the pipe has to be plastically deformed and the elastic spring-back is to be kept low. In order to ensure that the required material properties can be adjusted at the higher annealing temperatures, it may be necessary to use a so-called "fatter" input stock with a higher content of alloy components than is necessary per se.

The setting of the target diameter after tempering also takes place as previously. However, this is not achieved by sizing rolling after annealing but by a combination of the finished diameter of the rolling mill after rolling and of diameter growth during tempering, which is adjusted in a controlled manner.

A particular simplification of the production method can be achieved in that, with knowledge of the diameter growth of the pipe during tempering, a group of pipe types with the same nominal diameter but with wall thicknesses, material qualities or specifications which differ from each other is determined, for which a single finished diameter for the pipe to be tempered is adjusted after rolling. In this way, without expensive conversion of the rolling mill, different types of pipes with a single finished diameter for the pipe to be tempered after rolling can be rolled although these pipe types have different target diameters after tempering. It is possible at least by means of an appropriate grouping of pipe types for the number of finished diameters of the pipe to be tempered after rolling to be minimized and therefore the frequency of conversion of the rolling mill to be minimized.

Provision may be made that the tempering parameters are adjusted in such a way that starting from the single finished diameter for each pipe type in the group, a pipe is produced with its target diameter.

In order to optimize the production method, the finished diameter of the pipe after rolling may be measured and used as an input variable for the tempering process.

One embodiment of the invention makes provision for the tempering to consist of heating in a furnace, subsequent continuous flow cooling in a cooling path and an annealing process, the tempering parameters are adjusted on the basis of the bandwidth of previously determined connections between diameter, pipe wall thickness, material quality, tempering parameters and diameter growth, and that subsequently on the basis of the measured finished diameter of the pipe being rolled the tempering parameters are finely adjusted with respect to the target diameter of the pipe to be achieved after tempering. This method becomes reliable in terms of production, when the target diameters of the pipes to be tempered, which are being measured in the pipe rolling mill, are available to the tempering plant and the requirements for the selected control variables are finely adjusted on the basis of the dependencies of the diameter growth upon the pipe material and the quenching parameters.

Provision may be made that the target diameter of the pipe after tempering is adjusted by changing the cooling rate in the cooling path.

In the case of continuous flow cooling, the pipe which is heated to austenitization temperature and transported continuously via a roller conveyor is quenched in the conventional manner to the final temperature which is to be reached by means of stationary subjection to water. Influencing variables on the level of the cooling rate are, in addition to the pipe dimensions, in particular the temperature of the cooling water, the intensity of the water cooling as a quantity per unit of time and the transportation speed of the pipe over the roller conveyor.

The parameters of the quenching process may be improved if, during external cooling, the water quantity poured onto the pipe to be cooled is controllably adjusted between 50 and 300 $m^3$/hr, the cooling water temperature is controllably adjusted to below 40° C. and the transportation speed of the pipe in the cooling path is controllably adjusted to values between 0.1 and 1 m/s.

If necessary, in addition to the external cooling, internal cooling of the pipe can take place, wherein the quantity of cooling water should amount to between 50 and 250 $m^3$/hr.

While the external cooling can take place via two or more annular showers or annular sprays, the internal cooling is preferably effected via a lance which can be introduced into the pipe.

Alternatively, the heating used for hardening purposes, or for austenitization, can also take place in a furnace which has at least two zones over the furnace length, of which the first serves for heating purposes and the second for temperature equalization in the pipe.

Provision may also be made that the heating for hardening or austenitization of the pipe takes place in a first furnace and the temperature equalization in the pipe takes place in a second furnace.

In addition, it is more economical if the heating for hardening purposes, or for austenitization, takes place in a walking beam furnace with three zones, wherein the first zone serves for preheating, the second zone for heating and the third zone for temperature equalization in the pipe, and wherein the different zones can be located within one or several furnaces.

During tempering, the time at which the temperature is held at austenitization temperature may be at least 3 minutes, wherein the holding time begins when the lowest temperature achieved in the pipe reaches the value of the "desired pipe temperature minus 20° C.". In this way, optimal starting conditions for homogenous material properties of the pipe are created after the subsequent quenching process.

BRIEF DESCRIPTION OF THE DRAWINGS

The method in accordance with the invention is explained in more detail with the aid of the appended figures in which.

DESCRIPTION OF THE PREFERRED EMBODIMENT

Figure 1:
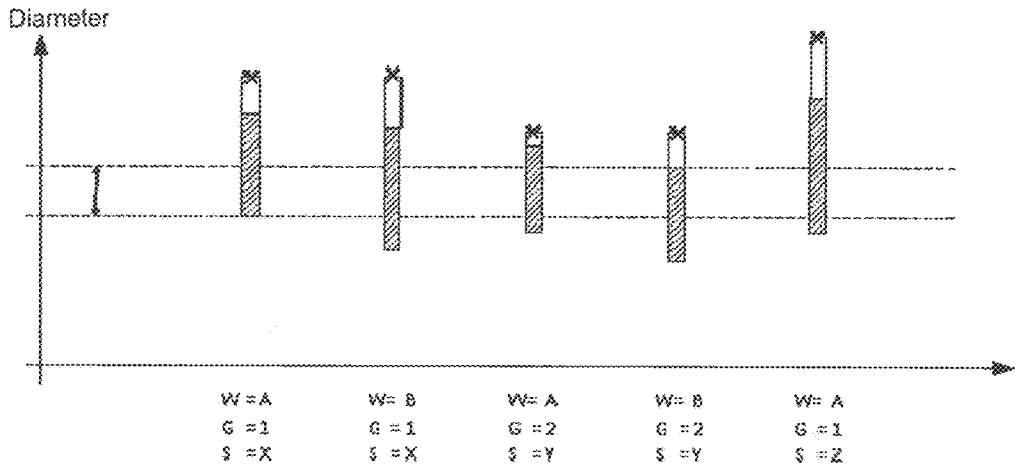
FIG. 1 is a schematic illustration of the factors influencing the target diameter after tempering.

FIG. 1 schematically illustrates how the method in accordance with the invention is applied in order that a single finished diameter for the rolling mill is set for different target diameters to be achieved after tempering. Target diameter is understood to be a desired variable. The finished diameter after rolling or the finished diameter after tempering is understood as a specific actual variable. FIG. 1 shows diameter values or ranges of five exemplified pipe types which are qualitatively defined by the influencing factors of wall diameter W, material quality G and specification S. Material quality G is to be understood essentially to be the material properties, and specification S is to be understood essentially to be the dimensions and tolerances.

Whether different pipe types can be rolled in one rolling mill with a single finished diameter in accordance with embodiments of the present invention, although the subsequent tempering leads to a different diameter growth, is explained with the aid of FIG. 1. For this purpose, the different target diameters after tempering (see the points marked with "x" in FIG. 1) are plotted for the five pipe types with the same nominal diameter in terms of a nominal width. These result from the specification S of the respective pipe type since all dimensions and tolerances are maintained. In a corresponding manner, the first and second or third and fourth pipe types with the same specification X or Y each have the same target diameter after tempering. Within the permitted tolerances of the specification, these could also easily be selected to be different from each other. By tests and production results, the minimum and maximum diameter growth in absolute values is now determined for each pipe type and, starting from the target diameter after tempering, is applied in terms of a reduction in diameter. The minimum diameter growth is plotted in the form of the region with a white background with the legend "Minimum growth of the pipe diameter during tempering" and results for this pipe type from the minimum required tempering parameters such as, e.g., a minimum cooling rate, in order to achieve the desired target structure during tempering. By changing the tempering parameters, it is possible at the start for the "Minimum growth of the pipe diameter during tempering" region to be enlarged with the minimum resulting diameter growth and a greater diameter growth to be achieved in a corresponding manner. This region of the additional diameter growth is plotted as a hatched region with the legend "Region of influence of the diameter growth". A comparison of the "Minimum growth of the pipe diameter during tempering" and "Region of influence of the diameter growth" regions for the five pipe types shows that there is a type of intersection region which is plotted with the arrow symbol and the legend "permitted region for the diameter prior to tempering". The diameter prior to tempering corresponds to the previously described finished diameter after rolling. The "permitted region for the diameter prior to tempering" is limited in the upwards direction by the smallest diameter of the five "Minimum growth of the pipe diameter during tempering" regions (see fourth pipe type from the left, value between the "Minimum growth of the pipe diameter during tempering" and "Region of influence of the diameter growth" regions). The "permitted region for the diameter prior to tempering" is defined in the downwards direction by the largest diameter of the respective lower limit value for the five "Region of influence of the diameter growth" regions (see first pipe type from the left, lowermost limit value of "Region of influence of the diameter growth").

On this basis, the finished diameter of the rolling mill is adjusted to a value within the "permitted region for the diameter prior to tempering" preferably in the middle of the "permitted region for the diameter prior to tempering". All five pipe types can now be rolled on this rolling mill uniformly and the target diameters deviating from each other at the end after tempering are achieved by an appropriate adjustment of the tempering parameters. The "permitted region for the diameter prior to tempering" has a sufficient bandwidth to also allow for any production tolerances. For other groups of pipe types with the same nominal diameter it can be the case that the resulting "permitted region for the diameter prior to tempering" is very narrow or there is no corresponding region in the sense of an intersection region. For this case, the groups are then to be selected differently or sub-groups of pipe types are to be formed for which then a "permitted region for the diameter prior to tempering" with a sufficient bandwidth again results.

FIGS. 2 to 5 show by way of example the dependency of the diameter growth of the pipe upon the tempering parameters, in particular the cooling parameters. With the aid of the adapted quenching parameters, in particular the pipe speed, the volume flow and with or without internal cooling, it is possible for an identical finishing diameter of the rolling mill, which is within preset tolerances of, e.g., +/−0.5%, to achieve the desired target diameter after tempering depending on pipe type.

Figure 2:
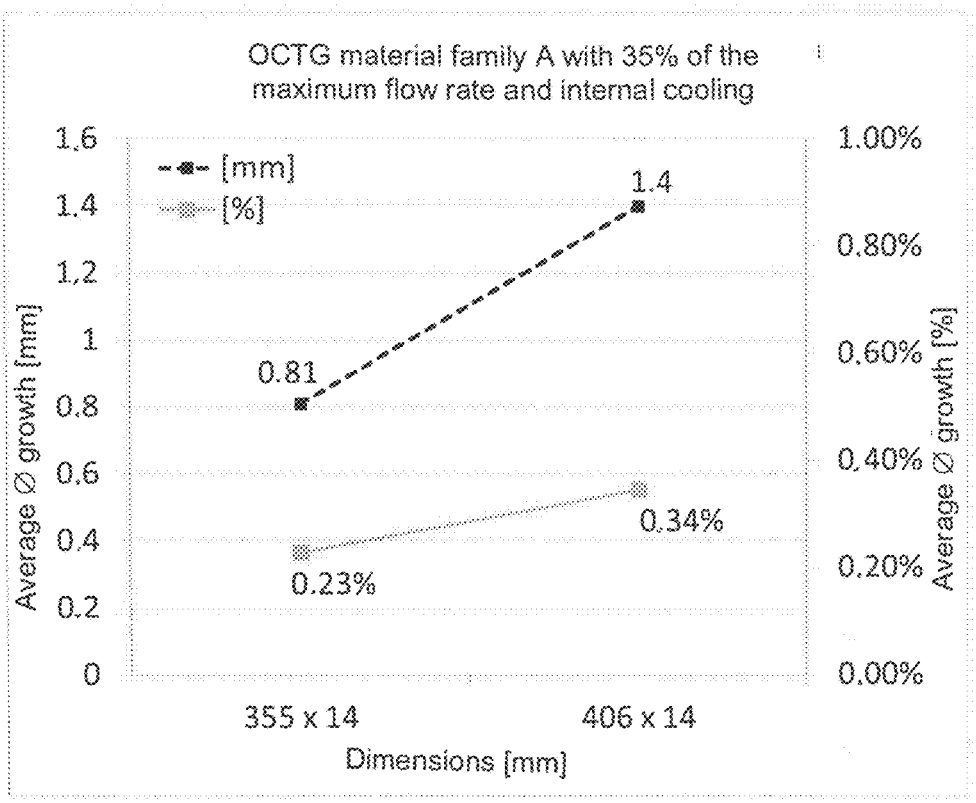
FIG. 2 illustrates the influence of the pipe diameter on the growth with internal cooling.

Thus, FIG. 2 shows how the growth of the diameter during tempering increases in dependence upon the diameter size with constant pipe wall thickness for a material family A from the oil field pipe range (OCTG).

The flow rate of the pipe through the cooling path is in this case kept constant at 35% of the maximum value, the quenching conditions on the outside, i.e., the water quantity, the number of annular showers and the water pressure. In addition, in this case the pipes were also quenched on the inside with a constant quantity of water over time.

Figure 3:
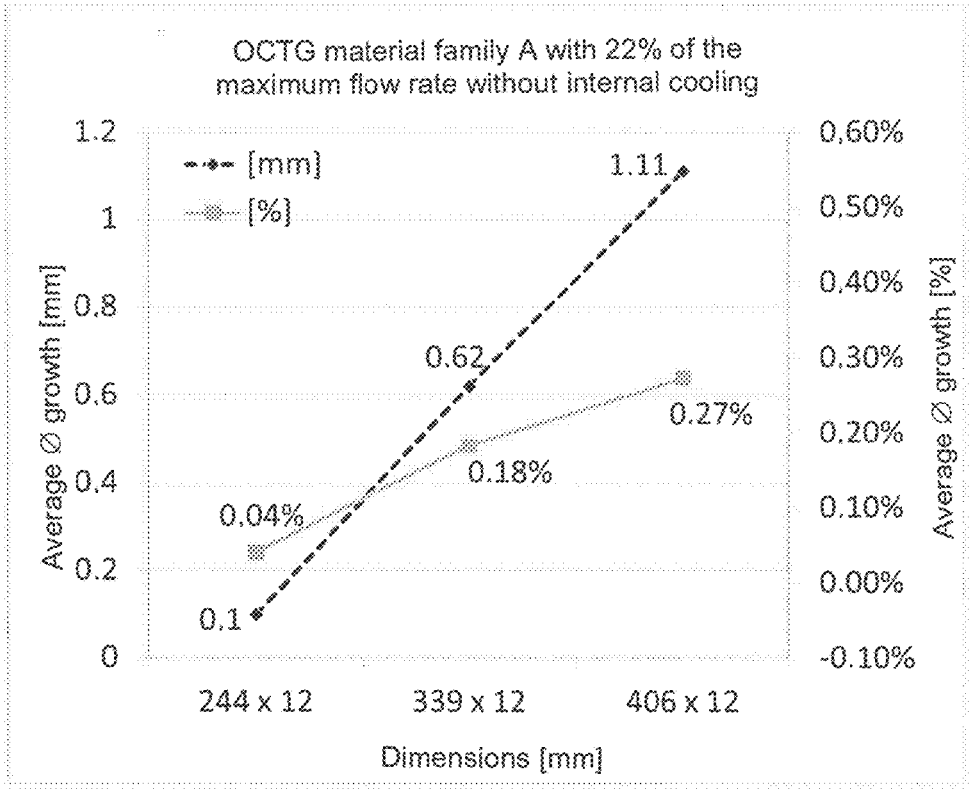
FIG. 3 illustrates the influence of the pipe diameter on the growth without internal cooling.

FIG. 3 shows the same dependency as FIG. 2, but without additional internal cooling and for a selected flow rate of 22% of the maximum value.

Figure 4:
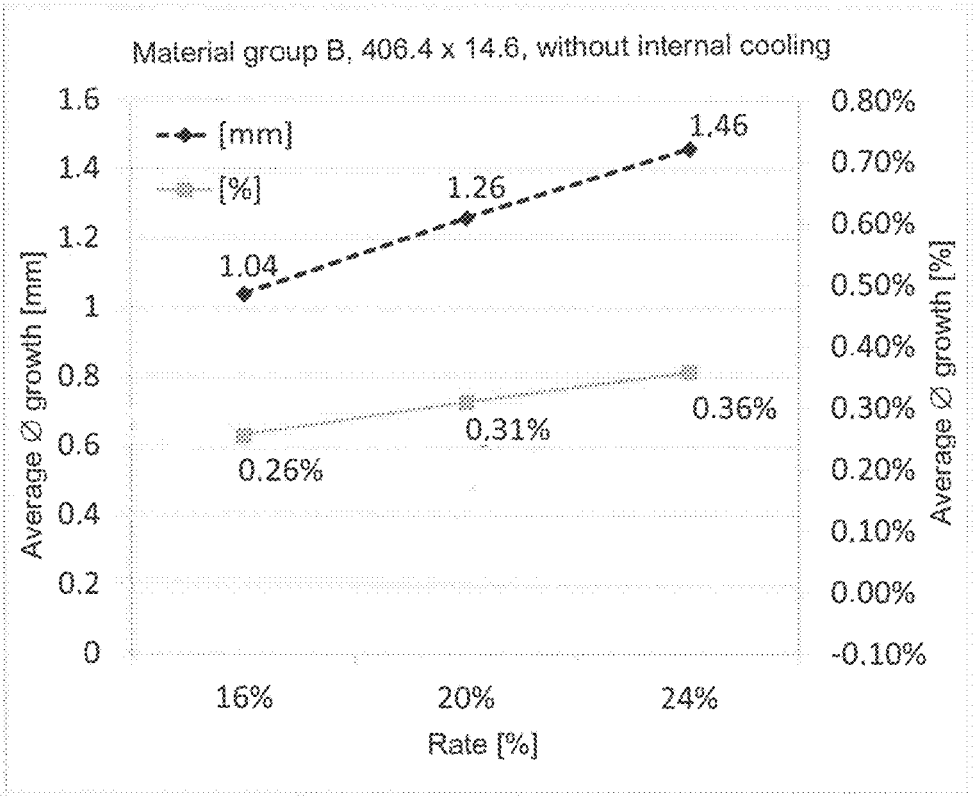
FIG. 4 illustrates the influence of the flow rate on the growth without internal cooling.
Figure 5:
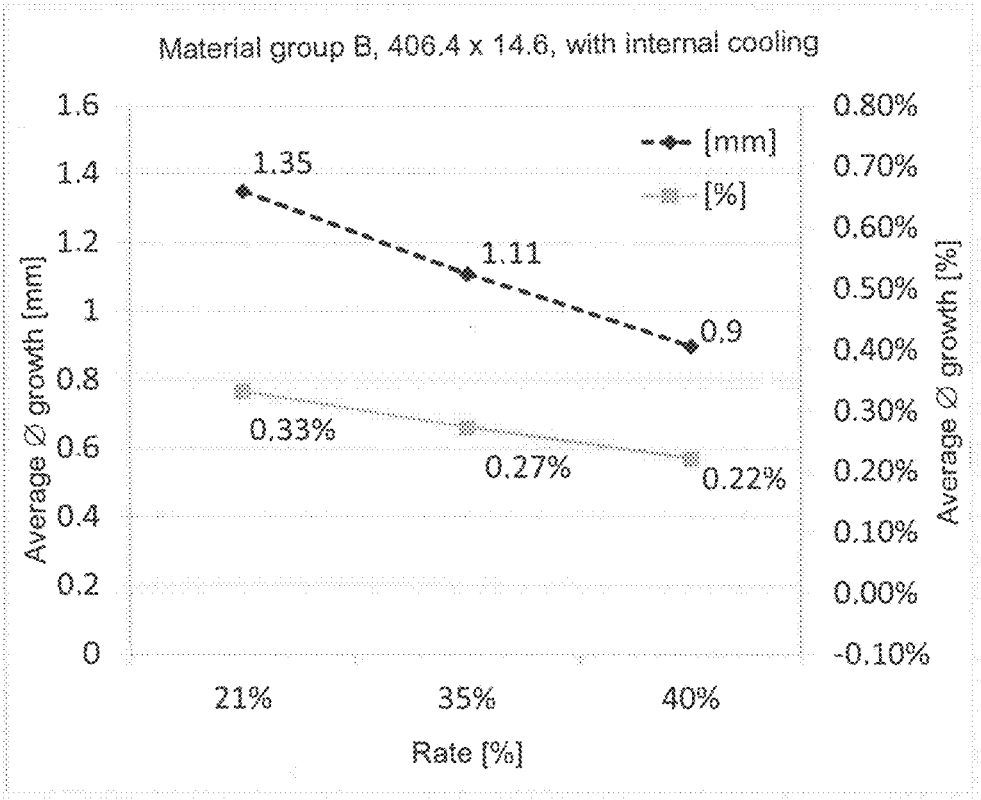
FIG. 5 illustrates the influence of the flow rate on the growth with internal cooling.

FIGS. 4 and 5 show how the selected flow rate influences the diameter growth of the pipe for the nominal dimensions 406.4×14.6 mm from the material group B. In this case, also the cooling conditions on the outside are kept constant. In the tests in accordance with FIG. 4, work was carried out without additional internal cooling, but in the tests in accordance with FIG. 5, work was carried out with internal cooling.

In the tables of values of FIGS. 4 and 5, the minimum and maximum growth are shown within practicable values for the tempering parameters, such as flow rate and "with" or "without" internal cooling. For the nominal dimensions 406.4×14.6 mm, FIG. 5 provides a minimum growth of the diameter of 0.9 mm and FIG. 4 a maximum growth of 1.46 mm.

The invention claimed is:

1. A method for producing a tempered, seamlessly hot-rolled steel pipe, comprising:

heating a hollow block to forming temperature and rolling the heated block in a rolling mill to form a pipe with a finished diameter after rolling;

subsequently tempering the pipe after said rolling with appropriate tempering parameters whereby the diameter of the pipe increases during said tempering; and adjusting the finished diameter of the pipe to be tempered after said rolling as a function of a value of the growth in diameter of the pipe during said tempering, and wherein the tempering comprises heating in a furnace, subsequent continuous flow cooling in a cooling path and an annealing process, adjusting the tempering parameters on the basis of a bandwidth of previously determined connections between diameter, pipe wall thickness, material quality, tempering parameters and diameter growth, and that subsequently on the basis of the measured finished diameter of the pipe being rolled finely adjusting the tempering parameters with respect to a target diameter of the pipe to be achieved after tempering.

2. The method as claimed in claim 1 including adjusting the tempering parameters to produce a pipe with the target diameter which corresponds to a finished diameter after tempering in a preset tolerance range.

3. The method as claimed in claim 1 wherein the finished diameter is achieved after tempering without the assistance of sizing rolling.

4. The method as claimed in claim 1 including adjusting the finished diameter for the pipe to be tempered as a function of a value of growth in the diameter of the pipe during tempering and of a value of growth in diameter of a group of pipes with a same nominal diameter as the pipe to be tempered but with wall thicknesses, material qualities or specifications which differ from each other.

5. The method as claimed in claim 4 including adjusting the tempering parameters in such a way that starting from a single finished diameter for each pipes in the group, a pipe is produced with the target diameter.

6. The method as claimed in claim 1 including measuring a finished diameter of the pipe after rolling.

7. The method as claimed in claim 1 including changing the target diameter of the pipe after tempering by changing a cooling rate in a cooling path.

8. The method as claimed in claim 7 including changing the cooling rate of external cooling of the pipe by varying at least one chosen from the quantity of cooling water, the temperature of the cooling water and the transportation speed of the pipe in the cooling path.

9. The method as claimed in claim 8 including controllably adjusting the water quantity poured onto the pipe to be cooled between 50 and 300 $m^3$/hr, controllably adjusting the cooling water temperature to below 40° C. and controllably adjusting the transportation speed of the pipe in the cooling path to values between 0.1 m/s and 1 m/s.

10. The method as claimed in claim 8 including internal cooling of the pipe in addition to the external cooling, wherein the quantity of cooling water is between 50 and 250 $m^3$/hr.

11. The method as claimed in claim 8 including using two or more annular showers or annular sprays for the external cooling.

12. The method as claimed in claim 1 including heating for hardening purposes in a furnace which has at least two zones over the furnace length, of which the first of said zones serves for heating purposes and the second of said zones serves for temperature equalization in the pipe.

13. The method as claimed in claim 1 including heating for hardening of the pipe in a first furnace and providing temperature equalization in the pipe in a second furnace.

14. The method as claimed in claim 12 wherein the heating for hardening purposes takes place in three zones, wherein the first zone serves for preheating, the second zone for heating and the third zone for temperature equalization in the pipe.

15. The method as claimed in claim 12 wherein the time at which the temperature is held at hardening temperature is at least 3 minutes, wherein the holding time begins when the lowest temperature achieved in the pipe reaches the value of the target pipe temperature minus 20° C.

16. The method as claimed in claim 14 wherein the different zones are located within one furnace.

17. The method as claimed in claim 14 wherein the different zones are located within a plurality of furnaces.

18. The method as claimed in claim 2 wherein the finished diameter is achieved after tempering without the assistance of sizing rolling.

19. The method as claimed in claim 2 including adjusting the finished diameter for the pipe to be tempered as a function of a value of growth in the diameter of the pipe during tempering and of values of growth in diameter of a group of pipes with the same nominal diameter as the pipe to be tempered but with wall thicknesses, material qualities or specifications which differ from each other.

* * * * *